US005099732A

United States Patent [19]

Hashida et al.

[11] Patent Number: 5,099,732

[45] Date of Patent: Mar. 31, 1992

[54] SHEET CUTTING APPARATUS

[75] Inventors: Yoshisuke Hashida, Hino; Hideo Takaoka, Tokyo; Yoshiharu Kamei, Urawa, all of Japan

[73] Assignee: Sun Seiki Co., Ltd., Tokyo, Japan

[21] Appl. No.: 599,115

[22] Filed: Oct. 17, 1990

[30] Foreign Application Priority Data

Oct. 18, 1989 [JP] Japan ..... 1-269103

[51] Int. Cl.[5] ..... B26D 1/22; B26D 5/02

[52] U.S. Cl. ..... 83/369; 83/428; 83/490

[58] Field of Search ..... 83/105, 145, 167, 428, 83/430, 490, 491, 492, 495, 505, 369

[56] References Cited

U.S. PATENT DOCUMENTS

| | | | |
|---|---|---|---|
| 1,235,691 | 8/1917 | Jagenberg | 83/428 |
| 2,792,858 | 5/1957 | Bryant | 83/491 |
| 3,815,458 | 6/1974 | Jirousek | 83/428 |
| 4,358,978 | 11/1982 | Lawson | 83/428 |
| 4,605,392 | 8/1986 | Achepohl et al. | 83/428 |
| 4,638,701 | 1/1987 | Oberlander et al. | 83/490 |
| 4,784,030 | 11/1988 | Waring | 83/105 |

FOREIGN PATENT DOCUMENTS

| | | | |
|---|---|---|---|
| 0161213 | 9/1984 | Japan | 83/428 |

*Primary Examiner*—Hien H. Phan

*Attorney, Agent, or Firm*—Finnegan, Henderson, Farabow, Garrett & Dunner

[57] ABSTRACT

Disclosed herein is a sheet cutting apparatus suitable for use in pre-cutting off an edge portion of a sheet of a large area. The apparatus comprises a sheet transfer mechanism; a first rotating shaft rotated through the torque of a motor; a turnable frame attached angularly movably along a circular orbit to the first rotating shaft; a second rotating shaft supported rotatably by the turnable frame so as to extend in a radial direction of the circular orbit of the turnable frame and meshed with the first rotating shaft to rotate therewith; a cutter blade and a backing blade, both, rotated by the torque of the second rotating shaft; and a turn control section for angularly moving reciprocally the turnable frame between an initial position at which the surface of revolution of the cutter blade and backing blade extends in a direction transferring a sheet and a separated position at which the cutter blade and backing blade turn aside from the transfer path of the sheet.

2 Claims, 4 Drawing Sheets

SHEET CUTTING APPARATUS

BACKGROUND OF THE INVENTION

1) Field of the Invention

The present invention relates to a sheet cutting apparatus suitable for use in pre-cutting off an edge portion of a sheet of a large area such as a design drawing when the sheet is folded vertically and horizontally so as to permit its filing with a paper fastener through a filing hole defined in another edge portion of the sheet, the cut off edge portion normally extending to cover the filing hole when folding the sheet.

2) Description of the Related Art

In order to keep sheets of a large area such as a design drawing so as to permit their easy handling, it has been conventional practice to fold the sheets vertically and horizontally, separately punch a filing hole in their one edge portion and then file them by a paper fastener.

It is, however, difficult to punch a filing hole only in a predetermined edge portion if the edge portion of each sheet, in which the filing hole is to be punched, overlaps another edge portion after folding the sheet vertically and horizontally.

It is therefore necessary to pre-cut the edge portion of the sheet, which will overlap with the filing hole-defining portion when folding the sheet.

However, enormous time and labor are required to manually effect such a cutting treatment. There is hence a problem that difficulties are encountered on a rapid treatment.

SUMMARY OF THE INVENTION

The present invention has been made in view of the aforesaid circumstances and has an object, the provision of a sheet cutting apparatus capable of automatically pre-cutting an edge portion of a sheet, which will overlap with a filing hole-defining portion when folding the sheet.

In order to attain the above object, according to this invention, there is thus provided a sheet cutting apparatus comprising a sheet transfer mechanism; a first rotating shaft rotated through the torque of a motor; a turnable frame attached for angular movement along an orbital path with respect to the first rotating shaft; a second rotating shaft supported rotatably by the turnable frame so as to extend in a radial direction of the orbital path of the turnable frame and meshed with the first rotating shaft to rotate therewith; a cutter blade and a backing blade, both, rotated by the torque of the second rotating shaft; and a turn control section for angularly moving reciprocally the turnable frame between an initial position at which the surface of revolution of the cutter blade and backing blade extends in a direction transferring a sheet and a separated position at which the cutter blade and backing blade turn aside from the transfer path of the sheet.

In a preferred embodiment of the present invention, the turn control section comprises a slider for transmitting turning moment to the turnable frame; a rotating shaft connected via a spring clutch to a gear rotated through the torque of the motor; a crank fixed to the rotating shaft; a connecting rod for connecting the crank to the slider; and a spring clutch control part for controlling the spring clutch, said spring clutch control part comprising a solenoid; two engaging blades fixed to a plunger of the solenoid; and an engaged projection for making the spring clutch a loosened state when engaged with either one of said two engaging blades, so that the first engaging blade is kept in a state that it is engaged with the engaged projection when starting the cutting of the sheet, the first engaging blade is disengaged from the engaged projection to rotate the crank when a cut length of the sheet reaches a predetermined length, the second engaging blade is engaged with the engaged projection when the turnable frame reaches the separated position, the second engaging blade is disengaged from the engaged projection to rotate the crank when the sheet is ejected, and the first engaging blade is engaged again with the engaged projection when the turnable frame returns to the initial position.

The turnable frame is first of all held in the initial position by the turn control section. In this initial position, the surface of revolution of the cutter blade and backing blade extends in the direction transferring the sheet.

When the motor is then operated, its torque is transmitted to the second rotating shaft via the first rotating shaft, whereby the rotation of both cutter blade and backing blade is started.

As the sheet is transferred in this state of operation an edge portion of the sheet passes between the cutter blade and the backing blade in a direction along their surface of revolution, during which the edge portion is gradually cut.

When the cut length of the sheet reaches the predetermined length, the turnable frame is angularly moved by the turn control section. Following this movement, both cutter blade and backing blade are moved along the orbital path around the second rotating shaft.

Therefore, the motion of the cutter blade and backing blade in relation to the sheet becomes a composite motion of the angular motion of the turnable frame and the linear motion of the sheet. The cutting line drawn by the cutter blade and backing blade is a smooth curve outwardly curving midway from the edge portion. Accordingly, the sheet is smoothly cut without being exposed to any unnatural force.

When the turnable frame reaches the separated position, both cutter blade and backing blade are turned aside from the edge portion, so that a part of the edge portion is completely cut off.

In the turn control section according to the preferred aspect of the present invention, the spring clutch is kept in a loosened state to stop the rotation of the crank before the cutting of the sheet is started. The turnable frame is hence held stably in the initial position.

As the cutting of the sheet is started and its cut length reaches the predetermined length, the first engaging blade is disengaged by the solenoid to tighten the spring clutch, so that the crank begins rotating to transmit its turning moment to the movable frame via the connecting rod and slider, whereby the angular movement toward the separated position of the turnable frame is started. This movement results in the complete cutting of the edge portion of the sheet.

When the turnable frame reaches the separated position, the second engaging blade makes the spring clutch loosen to stop the rotation of the crank. Accordingly, the turnable frame is stably held in the separated position.

When the sheet is ejected, the second engaging blade is disengaged by the solenoid to tighten the spring clutch, so that the crank is rotated to return the turnable frame to the original initial position. At this time, the first engaging blade is engaged with the engaged projection to stop the rotation of the crank, thereby returning to the original condition.

According to the present invention, the second rotating shaft with the cutter blade provided thereon is rotatably supported by the turnable frame which can be angularly moved reciprocally about and with the first rotating shaft provided on a base frame. Therefore, it is possible to cut off a part of an edge portion of a sheet without being exposed to any unnatural force by angularly moving the turnable frame when the cut length of the edge portion of the sheet reaches a predetermined length. It is now possible to bore, for example, a filing hole in the remaining part of the edge portion, which has been not cut off.

According to the preferred embodiment of this invention, the spring clutch, which is automatically controlled into a loosened or tightened state depending upon the transfer position of the sheet, is used to transmit the torque of a motor to the crank. Therefore, it is possible to angularly move reciprocally the turnable frame under control by making a common use of a motor which is a driving source for rotating the cutter blade and backing blade, and hence to make the apparatus small in size.

Other objects and advantages of the present invention will be readily appreciated from the preferred embodiments of this invention, which will be described subsequently in detail with reference to the accompanying drawings.

DETAILED DESCRIPTION OF THE INVENTION AND PREFERRED EMBODIMENTS

Figure 1:
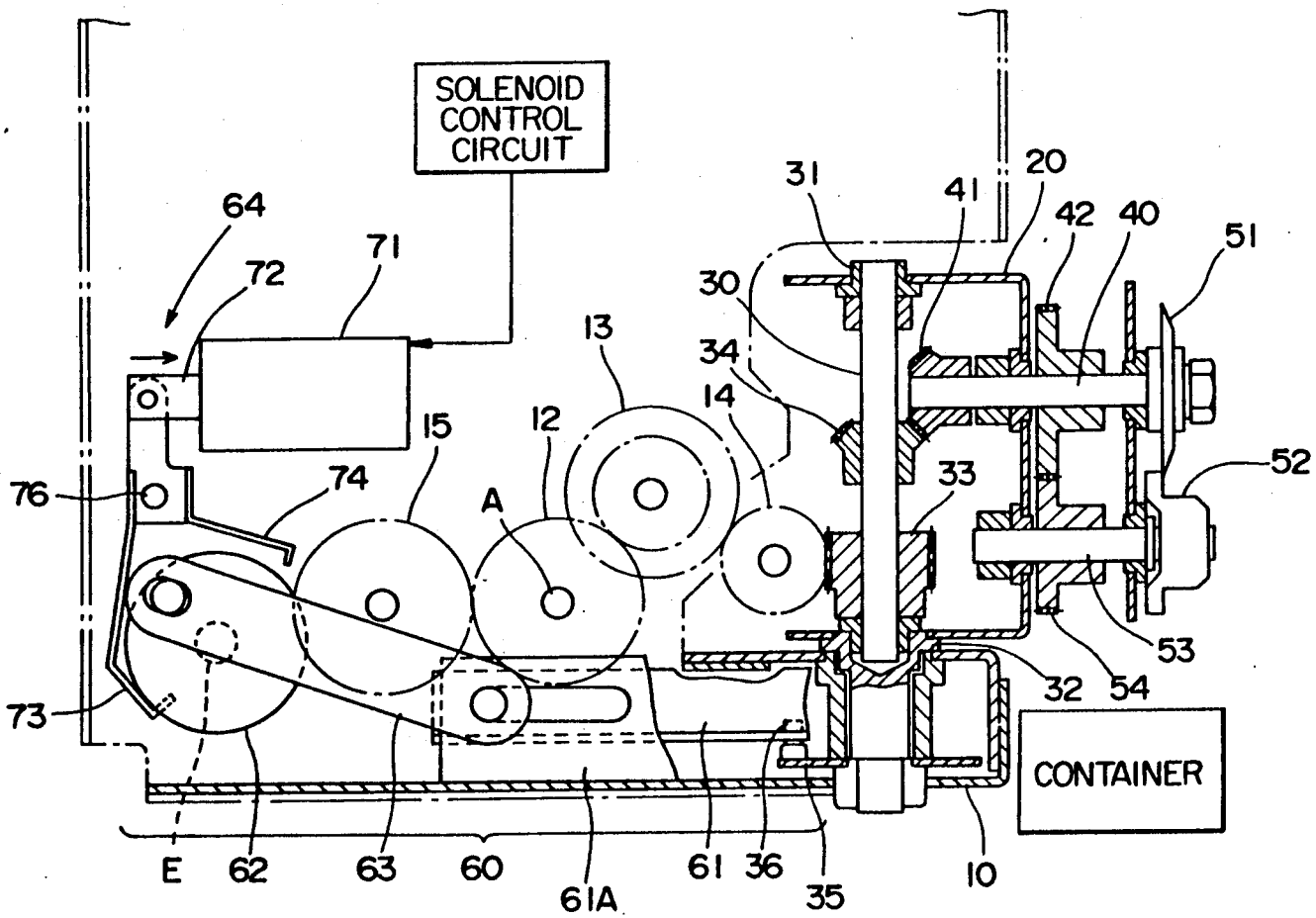
FIG. 1 is a schematic vertical sectional front elevation of a sheet cutting apparatus according to this invention.

As illustrated in FIG. 1, a first rotating shaft 30 is rotated by the torque of a motor (not illustrated). The first rotating shaft 30 is rotatably supported between a pair of bearings 31, 32 in an upright posture. Character A indicates a rotating shaft directly connected to the motor. To the rotating shaft A, is fixed a gear 12, the torque of which is transmitted to the first rotating shaft 30 via gears 13, 14, 33 which are successively meshed with one another. The gear 33 is fixed to the first rotating shaft 30 and serves to convert the horizontal torque of the gear 14 to a vertical torque.

A turnable frame 20 is angularly moved reciprocally about and with the first rotating shaft 30 along a circular orbit. This turnable frame 20 is fixed to the bearing 31, 32 for the first rotating shaft 30. The lower bearing 32 is pivotably supported by a base frame 10.

A second rotating shaft 40 is rotatably supported by the turnable frame 20 so as to extend in a radial direction of the circular orbit of the turnable frame 20 and meshed with the first rotating shaft 30 to rotate therewith. Numerals 34 and 41 designate bevel gears fixed to the first rotating shaft 30 and the second rotating shaft 40, respectively. By these bevel gears 34 and 41, the torque of the first rotating shaft 30 extending vertically is transmitted to the second rotating shaft 40 extending horizontally.

A cutter blade 51 and a backing blade 52 are rotated by the torque of the second rotating shaft 40. The cutter blade 51 is in the form of a disk, and is fixed to an end of the second rotating shaft 40 and hence directly rotated by the second rotating shaft. The backing blade 52 is fixed at a position facing the cutting blade 51 to an end of a rotating shaft 53 rotatably supported by the turnable frame. Numeral 54 and 42 indicate gears fixed to the rotating shaft 53 and the second rotating shaft 40, respectively. Since these gears 42 and 54 are intermeshed, the torque of the second rotating shaft 40 is transmitted to the rotating shaft 53 for the backing blade 52.

Figure 2:
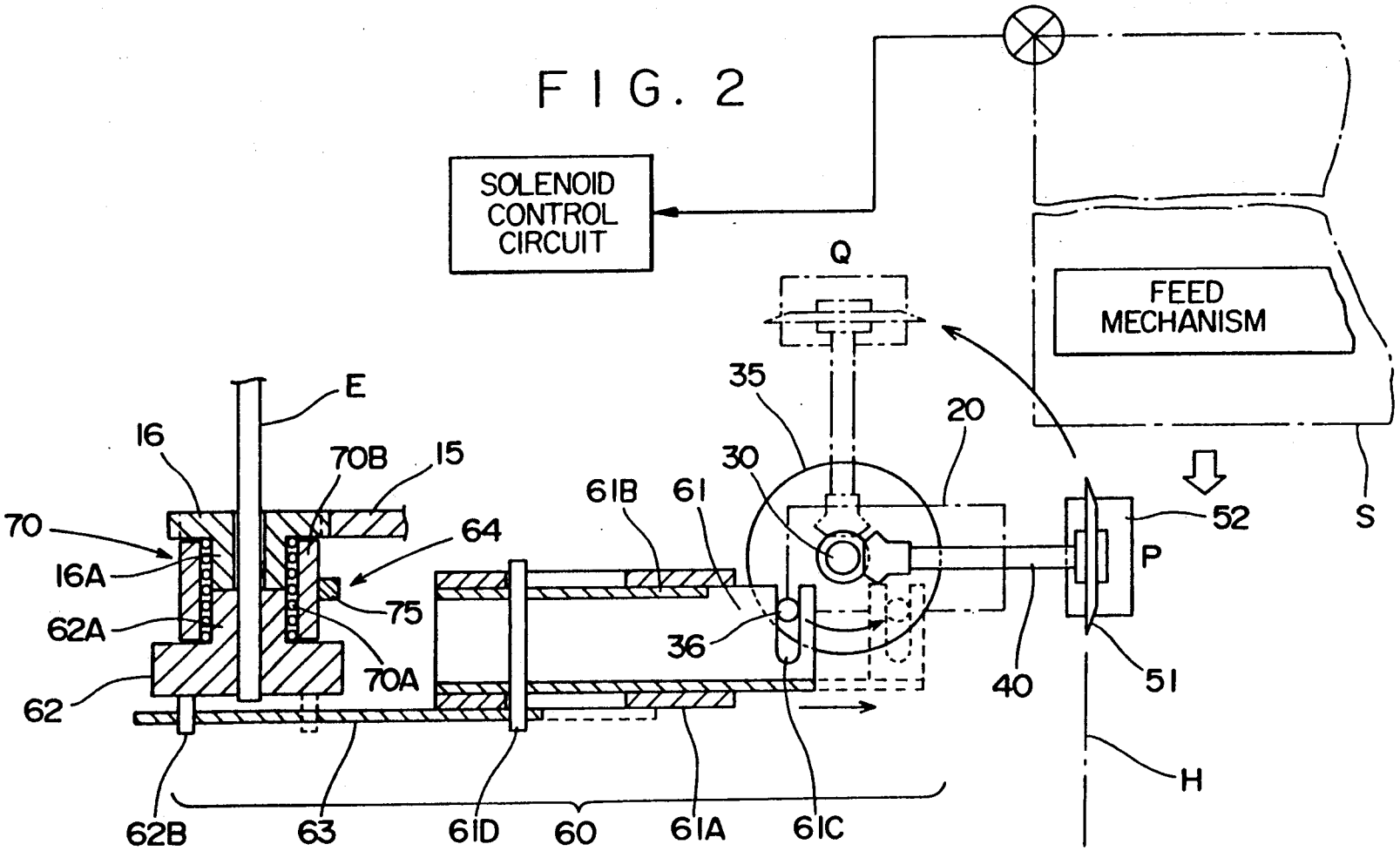
FIG. 2 is a schematic transverse sectional plan view illustrating a spring clutch control part.

As also illustrated in FIG. 2, a turn control section 60 serves to angularly move reciprocally more the turnable frame 20 angularly between an initial position P at which the surface H of revolution of the cutter blade 51 and backing blade 52 extends in a direction transferring a sheet S and a separated position Q at which the cutter blade 51 and backing blade 52 turn aside from the transfer path of the sheet S. Described specifically, the turn control section 60 comprises a slider 61, a spring clutch 70, a third rotating shaft E, a crank 62, a connecting rod 63 and a spring clutch control part 64.

The slider 61 serves to transmit turning moment to the turnable frame 20 and is held slidably in a direction intersecting with the direction transferring the sheet S in a pair of guides 61A, 61B provided on the base frame 10. A cutout 61C is defined in an end of the slider 61. The cutout 61C is brought into engagement with a projection 36 provided on a rotating plate 35 fixed to the lower bearing 32 for the first rotating shaft 30, so that the sliding movement of the slider 61 causes the rotation of the rotating plate 35 and the turnable frame 20 is hence rotated together with the rotating plate 35 through the bearing 32.

The third rotating shaft E is connected to a gear 16 rotated through the torque of the motor via the spring clutch 70. The torque of the motor is transmitted to the gear 16 through a gear 15 meshed with both gears 12 and 16. The gear 12 is always kept in a rotating state. Therefore, the gear 16 is also kept in the rotating state.

The crank 62 is fixed to the rotating shaft E and hence rotates therewith.

The spring clutch 70 comprises a spring 70A wound around shafts 16A and 62A of the gear 16 and the crank 62, one end of said spring 70A being fixed to the crank 62, and a holding member 70B provided so as to cover the outside of the spring 70A, to which the other end of the spring 70A is fixed. An engaged projection 75 is provided at a predetermined position on the outer periphery of the holding member 70B. When a first engaging blade 73 or a second engaging blade 74 is engaged with the engaged projection 75 to stop the rotation of the holding member 70B, the spring 70A is loosened, so that the gear 16 alone idles. When the engagement of the engaged projection 75 is released, on the other hand, the spring 70 is tightened, whereby the torque of the gear 16 is transmitted to both rotating shaft E and the crank 62.

The connecting rod 63 serves to connect the crank 62 to the slider 61. One end thereof is connected to an arm 61D of the slider 61 and the other end thereof is connected to a projection 62B of the crank 62. By this connecting rod 63, the rotational motion of the crank 62 is converted to the reciprocating motion of the slider 61.

The spring clutch control part 64 serves to control the spring clutch 70 and comprises a solenoid 71, the first engaging blade 73, the second engaging blade 74 and the control projection 75. The solenoid 71 is actuated by solenoid control circuit represented by the legend block 100 in FIG. 1 and which, as shown in FIG. 2, may be associated with a detector for detecting a transfer position of the trailing edge, for example, of the sheet S.

Both first and second engaging blades 73 and 74 are fixed, at their one ends, to a plunger 72 of the solenoid 71 and the other ends thereof are turnable on a pivot 76, whereby they can be brought into separable contact with the surface of the holding member 70B to which the control projection 75 has been fixed. When either one of the first and second engaging blades 73 and 74 come near to the holding member 70B, the other engaging blade is kept in a separated state.

The control projection 75 serves to make the spring clutch 70 a loosened state when engaged with either one of the first and second engaging blades 73 and 74, thereby causing the gear 16 alone to idle to stop the rotation of the rotating shaft E and crank 62.

Figure 3:
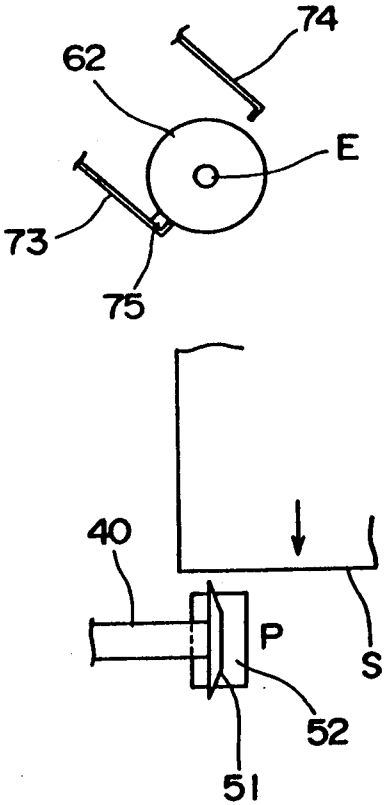
FIGS. 3 through 6 are explanatory illustrations showing the relation between movements of engaging blades and an engaged projection and angular movements of the cutter blade and backing blade.

Namely, at the time the cutting of the sheet S is started, the solenoid 71 is in a turn-off state and as illustrated in FIG. 3, the first engaging blade 73 is engaging with the control projection 75, so that the spring clutch 70 is made a loosened state. Accordingly, the gear 16 alone idles, so that the rotating shaft E and the crank 62 are not rotated and the turnable frame 20 is hence held stably in the initial position P. While the sheet S is passing between the cutting blade 51 and the backing blade 52, an edge portion of the sheet S, which extends along the advancing direction of the sheet S, is gradually cut.

Figure 4:
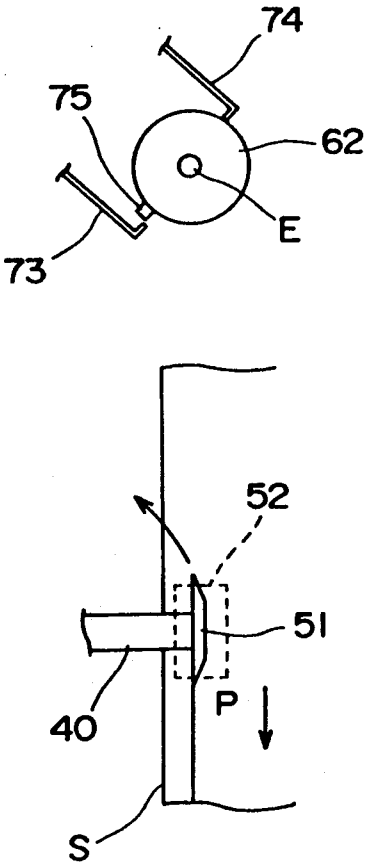

When the cut length of the sheet S reaches a predetermined length, the transfer position of the sheet S, for example, the rear end of the sheet S, is detected by an optical sensor 102 by way of example, so that the solenoid 71 is brought into a turn-on state to attract the plunger 72, and as illustrated in FIG. 4, the first engaging blade 73 is hence disengaged from the control projection 75, thereby making the spring clutch 70 a tightened state. At the same time, the second engaging blade 74 comes near to the holding member 70B and is held in a posture making it possible to engage with the control projection 75. Accordingly, the torque of the gear 16 is transmitted to both rotating shaft E and crank 62 and the rotational motion of the crank 62 is now converted through the connecting rod 63 to the advancing motion of the slider 61, so that turning moment is applied to the turnable frame 20 through the projection 36 engaged with the cutout C in the slider 61. As a result, the turnable frame 20 starts to angularly move from the initial position P toward the separated position Q.

Following the angular movement of the turnable frame 20, both cutter blade 51 and backing blade 52 move along the circular orbit. Namely, both cutter blade 51 and backing blade 52 angularly move, for example, by 90 degrees from the direction opposite to the transfer direction of the sheet S toward a direction separating from the edge portion of the sheet S, so that a part of the edge portion of the sheet S is cut off.

Figure 5:
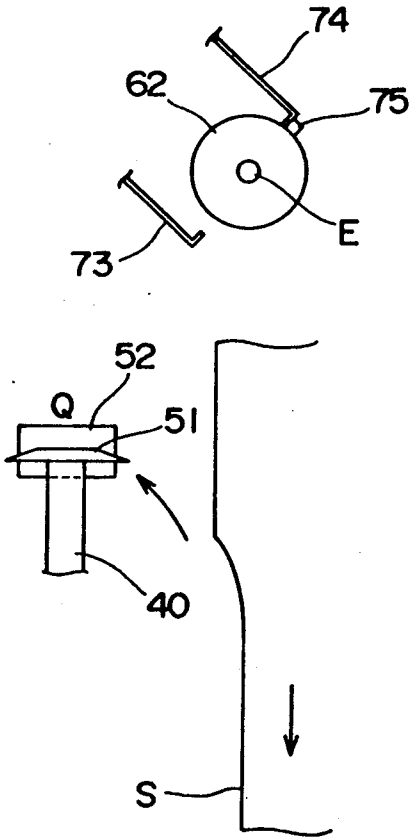

When the crank 62 make a half turn and the turnable frame 20 hence reaches the separated position Q, the second engaging blade 74 is engaged with the control projection 75 as illustrated in FIG. 5, so that the spring clutch 70 is made a loosened state and the gear 16 hence idles again to stop the rotation of both rotating shaft E and crank 62. Accordingly, the angular movement of the turnable frame 20 is stopped and the turnable frame 20 is held in the separated position Q.

When the sheet S is ejected, the solenoid 71 is brought into a turn-off state by detecting the fact that no longer sheet S is present on the transfer path, so that the plunger returns to the original condition and the second engaging blade 74 is hence disengaged from the control projection 75. As a result, the spring clutch 70 is made a tightened state and at the same time, the first engaging blade 73 comes near to the holding member 70B and is held in a posture making it possible to engage with the control projection 75. Accordingly, the torque of the gear 16 is transmitted to both rotating shaft E and crank 62 and the slider 61 is now moved back in the reverse direction, so that the turnable frame 20 starts to angularly move from the separated position Q toward the initial position P.

Figure 6:
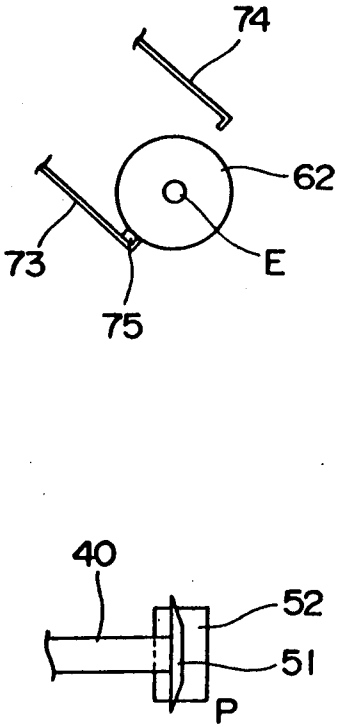

When the crank 62 makes just a turn and the turnable frame 20 returns to the initial position P, as illustrated in FIG. 6, the engagement of the first engaging blade 73 with the control projection 75 make the spring clutch 70 a loosened state. Accordingly, the gear 16 alone idles, so that the rotation of both rotating shaft E and crank 62 is stopped and the turnable frame 20 is hence held stably in the initial position P.

Figure 7:
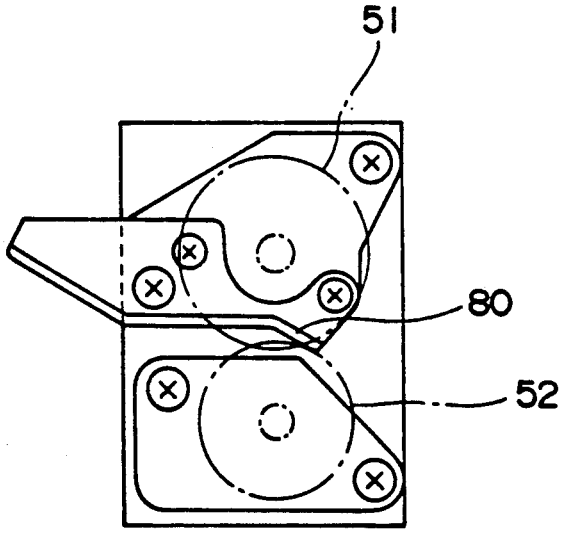
FIG. 7 is an explanatory illustration showing a down guide plate.

In this invention, it is preferable, as illustrated in FIG. 7, to dispose a down guide plate 80 for guiding a part of the edge portion of the sheet S, which is being cut by the cutting blade 51 and backing blade 52, while pressing it downwardly in a region through which the part of the edge portion will pass. It is also preferred that a receiving container is arranged under the down guide plate 80 to receive therein the cut-off piece of the sheet S, which has been guided downwardly.

What is claimed is:

1. A cutting apparatus comprising:

a sheet transfer mechanism for advancing a sheet in a transfer path;

a first rotating shaft driven in rotation by a motor;

a turnable frame attached to the first rotating shaft for angular movement along a circular orbital path;

a second rotating shaft supported rotatably by the turnable frame so as to extend in a radial direction of the circular orbital path of the turnable frame and rotatably driven by the first rotating shaft;

a cutting blade and a backing blade, both rotatably driven by the second rotating shaft; and a turn control section for reciprocally moving the turnable frame angularly between an initial position at which the surface of revolution of the cutter blade and the backing blade extends in a direction of sheet transfer and a separated position at which the cutter blade and backing blade are displaced from the transfer path of the sheet, the turn control section comprising:

a slider for transmitting turning moment to the turnable frame;

a third rotating shaft connected via a spring clutch to a gear rotated through the torque of the motor;

a crank fixed to the third rotating shaft;

a connecting rod for connecting the crank to the slider;

a spring clutch control part for controlling the spring clutch, said spring clutch control part comprising a solenoid, first and second engaging blades fixed to a plunger of the solenoid; and a control projection for releasing the spring clutch when engaged by either one of said first and second engaging blades, so that the first engaging blade is kept to be engaged with the control projection when starting the cutting of the sheet, the first engaging blade is disengaged from the control projection to engage the spring clutch and rotate the crank when a cut length of the sheet reaches a predetermined length, the second engaging blade is engaged with the control projection when the turnable frame reaches the separated position, the second engaging blade is disengaged from the control projection to rotate the crank when the sheet is ejected, and the first engaging blade is engaged again with the control projection when the turnable frame returns to the initial position.

2. A cutting apparatus as claimed in claim 1, which comprises a sensor for detecting the transfer position of the sheet, whereby the solenoid is controlled by the sensor.

* * * * *